US010858016B2

(12) United States Patent
Shubs, Jr. et al.

(10) Patent No.: US 10,858,016 B2
(45) Date of Patent: Dec. 8, 2020

(54) REMOTELY OPERATED RAILCAR HATCHES

(71) Applicant: Progress Rail Locomotive Inc., LaGrange, IL (US)

(72) Inventors: Alexander Shubs, Jr., Mount Prospect, IL (US); James David Seaton, Downers Grove, IL (US); David Matthew Roenspies, Elburn, IL (US)

(73) Assignee: Progress Rail Locomotive Inc., La Grange, IL (US)

( * ) Notice: Subject to any disclaimer, the term of this patent is extended or adjusted under 35 U.S.C. 154(b) by 426 days.

(21) Appl. No.: 15/802,208

(22) Filed: Nov. 2, 2017

(65) Prior Publication Data

US 2019/0126946 A1 May 2, 2019

(51) Int. Cl.

| | |
|---|---|
| ***B61D 7/24*** | (2006.01) |
| ***B61L 15/00*** | (2006.01) |
| ***B61L 25/04*** | (2006.01) |
| ***B61D 7/02*** | (2006.01) |
| *E05F 17/00* | (2006.01) |
| *E05F 15/77* | (2015.01) |

(52) U.S. Cl.

CPC ..... *B61D 7/24* (2013.01); *B61D 7/02* (2013.01); *B61L 15/009* (2013.01); *B61L 15/0018* (2013.01); *B61L 15/0081* (2013.01); *B61L 25/04* (2013.01); *B61L 2201/00* (2013.01); *E05F 15/77* (2015.01); *E05F 17/00* (2013.01); *E05F 2017/008* (2013.01); *E05Y 2400/44* (2013.01); *E05Y 2400/45* (2013.01); *E05Y 2400/81* (2013.01); *E05Y 2900/51* (2013.01)

(58) Field of Classification Search

CPC ..... B61D 7/24; B61D 7/30; E05Y 2400/81; E05Y 2400/818; E05Y 2400/82; E05Y 2900/51; B61L 15/0081; B61L 15/009; B61L 25/04; B61L 2201/00

See application file for complete search history.

(56) References Cited

U.S. PATENT DOCUMENTS

| | | | | | |
|---|---|---|---|---|---|
| 5,359,942 | A * | 11/1994 | Ward | B61D 7/30 | 105/240 |
| 5,423,268 | A * | 6/1995 | Bounds | B61D 7/24 | 104/2 |
| 5,657,700 | A * | 8/1997 | Bounds | B61D 7/30 | 104/2 |

(Continued)

*Primary Examiner* — Michael McCullough

(74) *Attorney, Agent, or Firm* — Miller Matthias & Hull

(57) ABSTRACT

A railcar hatch control system and method for operating railcar hatches of a multi-railcar train is disclosed. A multi-railcar train may have a locomotive and a plurality of railcars having railcar hatches that can be opened and closed. The system and method may include displaying railcar identification information for the railcars on an operator display device, and receiving selections of railcars from an operator that will have a railcar hatch operation performed thereon, such as opening or closing the hatches. The railcar hatch operation is input, and the system and method control the railcar hatch operation being performed only on the selected railcars, and not on the railcars that have not been selected by the operator. The system and method may have operator interfaces devices at an operator station of the train, or at a remote location or on a remote device that communicates wirelessly with the train.

20 Claims, 8 Drawing Sheets

(56) References Cited

U.S. PATENT DOCUMENTS

| | | | | |
|---|---|---|---|---|
| 6,526,339 | B1 * | 2/2003 | Herzog | B61L 25/025 105/311.1 |
| 6,758,147 | B2 * | 7/2004 | Howard | B61D 7/32 105/247 |
| 6,903,652 | B2 * | 6/2005 | Noguchi | B60R 11/02 340/425.5 |
| 6,980,117 | B1 * | 12/2005 | Kirkland | G08B 13/08 340/5.7 |
| 7,389,732 | B2 * | 6/2008 | Taylor | B61D 7/28 105/286 |
| 8,534,204 | B2 * | 9/2013 | Blankenship | B61D 7/02 105/247 |
| 8,701,565 | B2 * | 4/2014 | Creighton | B61D 7/00 105/377.06 |
| 9,452,294 | B2 * | 9/2016 | Kaula | A61N 1/37247 |
| 9,694,834 | B2 * | 7/2017 | Shubs, Jr. | B61L 15/0081 |
| 9,718,486 | B1 * | 8/2017 | Shubs, Jr. | B61L 15/0081 |
| 9,738,294 | B2 * | 8/2017 | Shubs, Jr. | B61L 27/04 |
| 10,449,975 | B2 * | 10/2019 | Huck | B61D 7/02 |
| 2007/0084378 | A1 * | 4/2007 | Creighton | B61D 7/28 105/247 |
| 2016/0129851 | A1 * | 5/2016 | Werner | B60R 13/0243 701/49 |
| 2016/0130853 | A1 * | 5/2016 | Tehranchi | E05F 15/60 340/3.71 |
| 2017/0032316 | A1 * | 2/2017 | Benedict | G06Q 10/0833 |
| 2017/0072973 | A1 * | 3/2017 | Shubs | B61L 25/025 |
| 2019/0225248 | A1 * | 7/2019 | Lidgett | B61L 15/0081 |
| 2019/0303975 | A1 * | 10/2019 | Kusukame | G06Q 30/0202 |

* cited by examiner

REMOTELY OPERATED RAILCAR HATCHES

TECHNICAL FIELD

The present disclosure relates generally to multi-railcar trains and, more particularly, to systems and methods for remotely operating railcar hatches on selected ones of hatch railcars of multi-railcar trains.

BACKGROUND

A train typically consists of a lead locomotive and a plurality of railcars connected in a line behind the locomotive. The locomotive, although generally located at the leading end of the multi-railcar train, can alternatively be located at any other position along its length so that railcars may be connected to the front of the locomotive, to the rear of the locomotive, or to both. There are a variety of types of railcars that can be connected in the line depending on the type of cargo being hauled by the train, including boxcars that are fully enclosed cars and have side or end doors, combine cars that combine a passenger car with a boxcar on one railcar, flatcars that are flat and open and may be specialized for particular types of cargo, stock cars that are ventilated boxcars for livestock, and tank cars having tankers for transporting liquids or gases.

Gondolas are railcars that have an open top and enclosed sides and ends for shipping bulk goods. Hoppers are similar to gondolas, but have bottom dump doors or hatches for easy unloading of cargo such as coal, ore, grain, cement, ballast and the like. Covered hoppers are specialized hopper cars with a cover or top wall that may be used for weather-sensitive loads such as grain, cement, pellets and the like. The top walls of the covered hoppers will typically have top doors or hatches to cover a top opening during transit and to open to allow loading of the cargo into the hopper. One example of a hopper railcar having top and bottom hatches is provided in U.S. Pat. No. 8,701,565 that was issued to Creighton et al. on Apr. 22, 2014, entitled "System and Method for Powered Railcar Doors."

In current systems for controlling the hatches, the locomotive operator has two switches on a control panel in the operator station of the locomotive. A top hatch switch controls opening and closing of all railcar top hatches as a group, and a bottom hatch switch controls opening and closing of all railcar bottom hatches as a group. In response to operation of the hatch switches, control signals may be carried over electronically controlled pneumatic braking (ECPB) lines to cause all top hatches to open or close and/or all bottom hatches to open or close. The locomotive operator cannot open a hatch on a particular railcar without opening similar hatches in all the other railcars.

SUMMARY OF THE DISCLOSURE

In one aspect of the present disclosure, a method for operating railcar hatches of a multi-railcar train having a locomotive and a plurality of railcars coupled in a line behind the locomotive is disclosed. The method may include displaying railcar identification information for each of the plurality of railcars on an operator display device, selecting the railcar identification information for one of the plurality of railcars that is a hatch railcar having a railcar hatch, selecting a railcar hatch operation to be performed on the railcar hatch of the one of the plurality of railcars, wherein the railcar hatch operation is one of opening the railcar hatch and closing the railcar hatch of the one of the plurality of railcars, and executing the railcar hatch operation on the railcar hatch of the one of the plurality of railcars in response to selecting the railcar hatch operation. The railcar hatch operation is executed without executing the railcar hatch operation on the plurality of railcars that were not selected.

In another aspect of the present disclosure, a railcar hatch control system for a multi-railcar train is disclosed. The multi-railcar train has a locomotive and a plurality of railcars coupled in a line behind the locomotive, wherein more than one of the plurality of railcars are hatch railcars each having a railcar hatch that is movable by a railcar hatch actuator between a railcar hatch open position and a railcar hatch closed position. The railcar hatch control system may include an operator display device, an operator input device, and a controller operatively connected to the operator display device, the operator input device and the railcar hatch actuator of each of the hatch railcars. The controller may be programmed to cause the operator display device to display railcar identification information for each of the plurality of railcars, to receive a railcar selection input signal from the operator input device representing selecting the railcar identification information for one of the hatch railcars, to receive a railcar hatch operation input signal from the operator input device representing selecting a railcar hatch operation to be performed on the railcar hatch of the one of the hatch railcars, wherein the railcar hatch operation is one of opening the railcar hatch and closing the railcar hatch of the one of the hatch railcars, and to transmit a railcar hatch actuator control signal to the railcar hatch actuator of the one of the hatch railcars to cause the railcar hatch actuator to execute the railcar hatch operation of the railcar hatch operation input signal on the railcar hatch of the one of the hatch railcars in response to receiving the railcar hatch operation input signal. The railcar hatch operation is executed without executing the railcar hatch operation on railcar hatches of the hatch railcars that are not the one of the hatch railcars.

In a further aspect of the present disclosure, a method for operating railcar hatches of a multi-railcar train having a locomotive and a plurality of railcars coupled in a line behind the locomotive. The method may include displaying railcar identification information for each of the plurality of railcars on an operator display device, selecting the railcar identification information for a first subset of the plurality of railcars that are hatch railcars each having a railcar hatch, selecting a railcar hatch operation to be performed on the railcar hatch of each of the first subset of the plurality of railcars, wherein the railcar hatch operation is one of opening the railcar hatch and closing the railcar hatch of each of the first subset of the plurality of railcars, and executing the railcar hatch operation on the railcar hatch of each of the first subset of the plurality of railcars in response to selecting the railcar hatch operation. The railcar hatch operation is executed without executing the railcar hatch operation on the railcar hatch of each of the hatch railcars that were not selected.

Additional aspects are defined by the claims of this patent.

DETAILED DESCRIPTION

Figure 1:
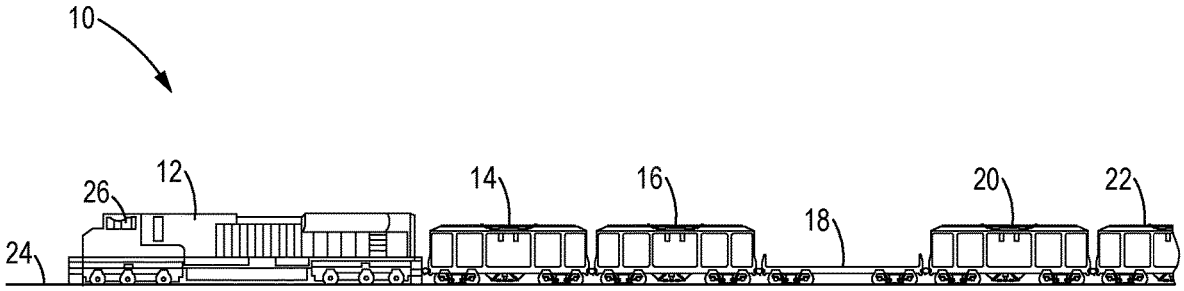
FIG. 1 is a side view of a portion of a multi-railcar train in which remotely operated railcar hatches in accordance with the present disclosure may be implemented.

Referring to FIG. 1, an exemplary multi-railcar train 10 in which remotely operated railcar hatch control systems in accordance with the present disclosure may be implemented is illustrated. The multi-railcar train 10 may include a locomotive 12 and a plurality of railcars 14-22 coupled in a line behind the locomotive 12 on a railroad track 24. The locomotive 12 includes an engine (not shown) to provide the driving force for the multi-railcar train 10, and an operator station 26 occupied by the train operators or engineers and having operator interface devices that allow the operators to control the locomotive 12 and monitor the status of various operating parameters. Depending on the power required to drive the multi-railcar train 10, additional locomotives 12 may be coupled at the front of the multi-railcar train 10, at the rear of the multi-railcar train 10 or at other appropriate locations in between.

Figure 2:
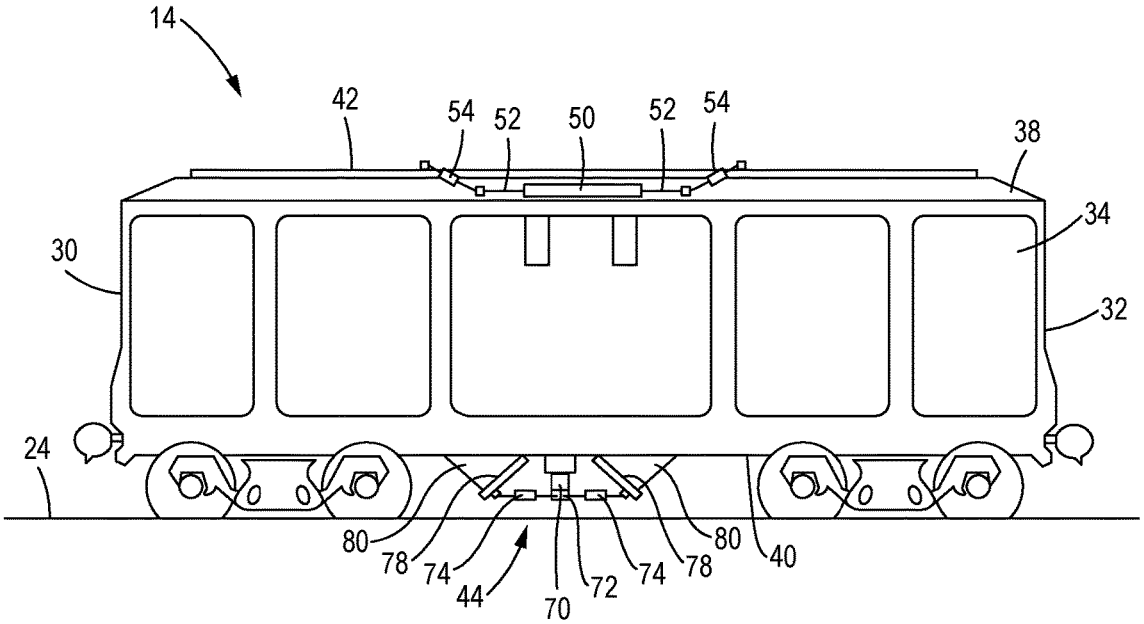
FIG. 2 is a side view of a hatch railcar of the multi-railcar train of FIG. 1 in which remotely operated railcar hatch control in accordance with the present disclosure may be implemented.

The railcars 14-22 and additional railcars (not shown) of the multi-railcar train 10 may all be the same type of railcar, or can be a combination of the railcar types discussed above, or other types of railcars. In the illustrated multi-railcar train 10, the railcars 14, 16, 20, 22 are covered hopper railcars, and the railcar 18 is a flat car. The railcar 14 is shown in greater detail in FIG. 2. As illustrated, the railcar 14 is fully enclosed and has end walls 30, 32, side walls 34, 36 (FIGS. 3 and 4), a roof or top wall 38 and a bed or bottom wall 40. The illustrated railcar 14 further includes a top hatch 42 to facilitate loading cargo into the railcar 14, and a bottom hatch 44 for unloading cargo. The bed or bottom wall 40 of the railcar 14 may be shaped to feed the stored cargo toward the bottom hatch 44 to facilitate complete emptying of the railcar 14.

Figure 3:
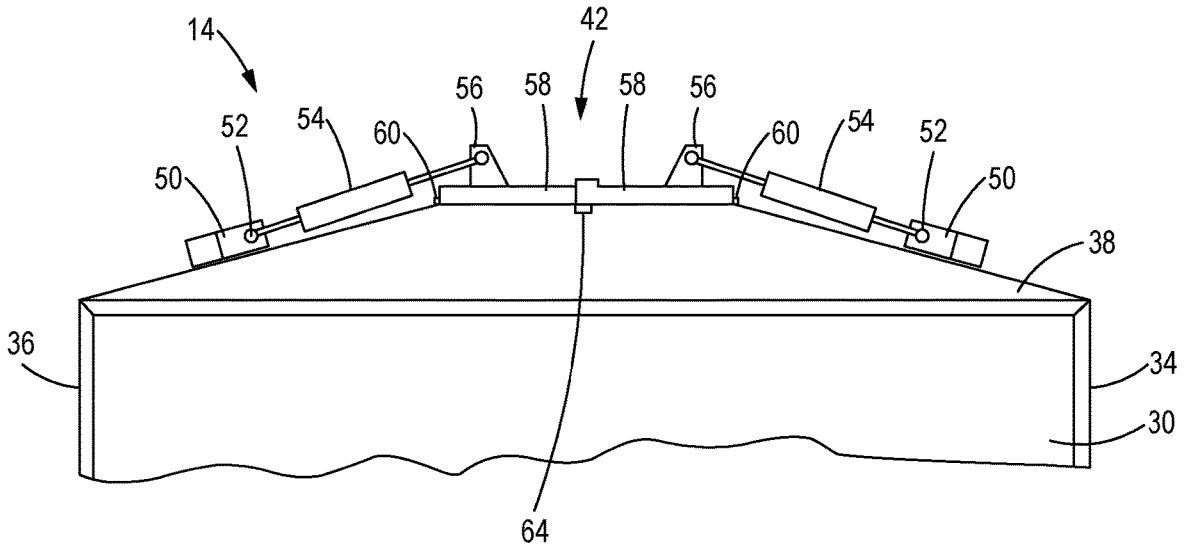
FIG. 3 is a partial end view of a top portion of a hatch railcar illustrating top hatch doors in a closed position.

The railcar 14 may include automated opening and closing mechanisms for the top hatch 42 and the bottom hatch 44 that may be controlled from the operator station 26 of the locomotive 12, from a remote location such as a back office operator location at the site where the railcar 14 is filled with cargo or emptied, or from a remote device such as a laptop computer, a tablet computer, a smartphone or the like, with the remote devices communicating with the multi-railcar train 10 via a wireless communication link as known in the art. As illustrated, the railcar 14 has a top hatch actuator 50 mounted on the top wall 38 of the railcar 14 and having top hatch actuator arms 52 extending there from. Top hatch linkages 54 connect the top hatch actuator arms 52 to top hatch brackets 56 to operatively connect the top hatch actuator 50 to the top hatch 42. Referring to FIG. 3, the top hatch 42 may include a pair of top hatch doors 58 pivotally connected to the top wall 38 by top hatch hinges 60 and having the top hatch brackets 56 mounted thereon. As shown, the railcar 14 includes a separate set of top hatch actuators 50 and top hatch linkages 54 for each of the top hatch doors 58, but those skilled in the art will understand that the top hatch doors 58 may be connected to each other by an additional linkage so that a single top hatch actuator 50 and top hatch linkage 54 can open both top hatch doors 58. Alternatively, the top hatch doors 58 may be replaced by a single top hatch door 58.

Figure 4:
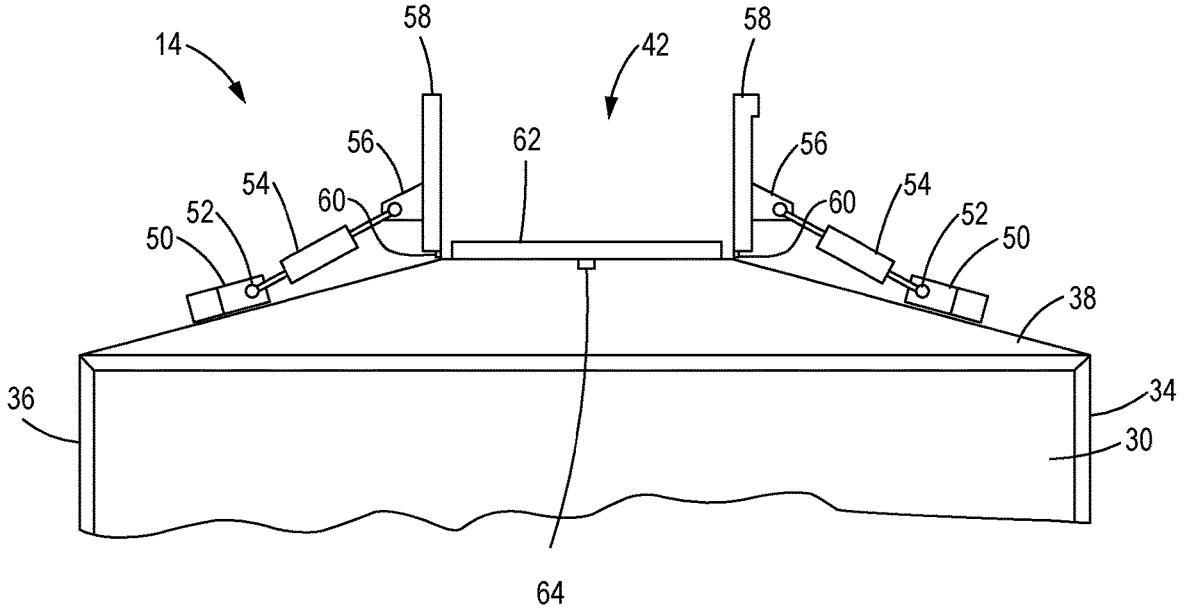
FIG. 4 is the partial end view of the hatch railcar of FIG. 3 with the top hatch doors in an open position.

Upon receiving railcar hatch actuator control signals from a control source, the top hatch actuators 50 may actuate to retract the top hatch actuator arms 52 to cause the top hatch linkages 54 to move the top hatch doors 58 from the closed position of FIG. 3 to a top hatch open position of FIG. 4. With the top hatch doors 58 open, cargo can be loaded into the railcar 14 through a top hatch opening 62. After the cargo is loaded, subsequent railcar hatch actuator control signals may cause the top hatch actuators 50 to extend the top hatch actuator arms 52 and cause the top hatch linkages 54 to close the top hatch doors 58.

A top hatch position sensor 64 may be provided to detect whether the top hatch doors 58 are in the top hatch closed position of FIG. 3. In the illustrated embodiment, the top hatch position sensor 64 may be any appropriate type of sensor capable of detecting an absolute position of the top hatch doors 58, or a relative position or displacement of the top hatch doors 58 from which the absolute position may be determined. The top hatch position sensor 64 may alternatively be associated with another element such as the top hatch actuator 50, the top hatch linkage 54 or other element of the top hatch 42 whose position or other operating parameter may be used to determine the position of the top hatch doors 58. The top hatch position sensor 64 may transmit top hatch position sensor signals back to the control source to provide the control source and/or an operator with real-time information on the status of the top hatch 42 as being open or closed.

Figure 5:
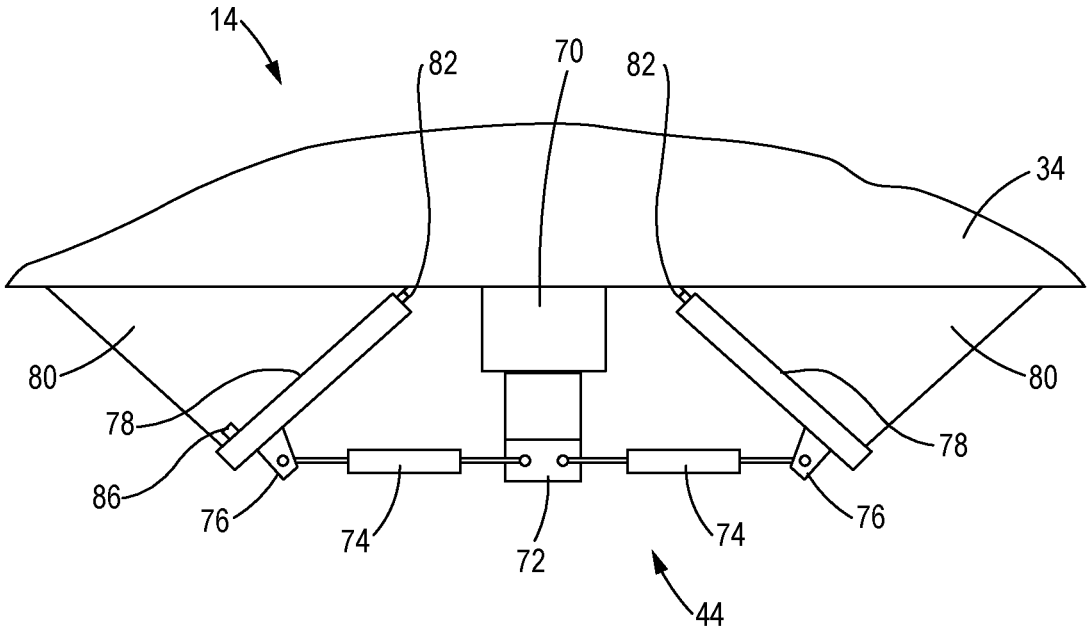
FIG. 5 is a partial side view of a bottom portion of a hatch railcar illustrating bottom hatch doors in a closed position.

Returning to FIG. 2, the bottom hatch 44 has a bottom hatch actuator 70 mounted on the bottom wall 40 of the railcar 14 and having bottom hatch actuator bracket 72 extending there from. Bottom hatch linkages 74 connect the bottom hatch actuator bracket 72 to bottom hatch brackets 76 to operatively connect the bottom hatch actuator 70 to the bottom hatch 44. Referring to FIG. 5, the bottom hatch 44 may include a pair of bottom hatch doors 78 pivotally connected to corresponding bottom hatch chutes 80 by bottom hatch hinges 82 and having the bottom hatch brackets 76 mounted thereon. As shown, the railcar 14 includes a single bottom hatch actuator 70 to open and close both bottom hatch doors 78, but those skilled in the art will understand that the bottom hatch doors 78 may have separate bottom hatch actuators 70 for controlling their positions. Alternatively, the bottom hatch doors 78 and bottom hatch chutes 80 may be replaced by a single bottom hatch door 78 and bottom hatch chute 80.

Figure 6:
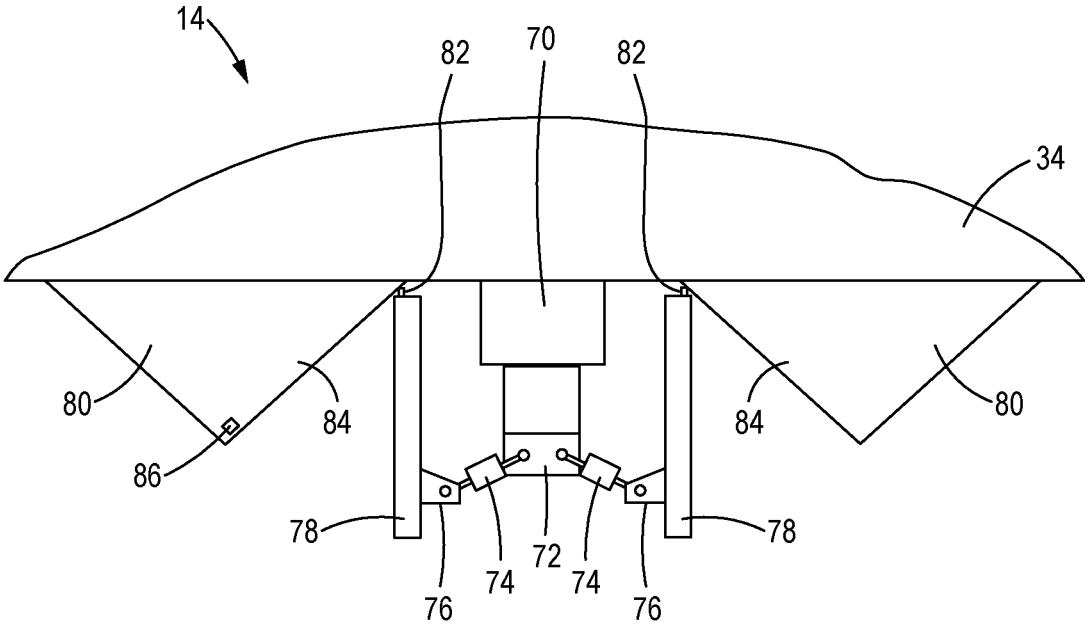
FIG. 6 is the partial end view of the hatch railcar of FIG. 5 with the bottom hatch doors in an open position.

Upon receiving railcar hatch actuator control signals from the control source, the bottom hatch actuator 70 may actuate to displace the bottom hatch actuator bracket 72 to cause the bottom hatch linkages 74 to move the bottom hatch doors 78 from the closed position of FIG. 5 to a bottom hatch open position of FIG. 6. With the bottom hatch doors 78 open, cargo can be unloaded from the railcar 14 through bottom hatch openings 84 of the bottom hatch chutes 80. After the cargo is unloaded, subsequent railcar hatch actuator control signals may cause the bottom hatch actuator 70 to return the bottom hatch actuator bracket 72 and cause the bottom hatch linkages 74 to close the bottom hatch doors 78.

Similar to the top hatch 42, the bottom hatch 44 may include a bottom hatch position sensor 86 to detect whether the bottom hatch doors 78 are in the bottom hatch closed position of FIG. 5. As with the top hatch position sensor 64, the bottom hatch position sensor 86 may be any appropriate type of sensor capable of providing the control source and the operator with real-time information on the status of the bottom hatch 44 as being open or closed. The bottom hatch position sensor 86 may transmit bottom hatch position sensor signals back to the control source at scheduled intervals, when a change in the position of the bottom hatch door 78 is detected, or when any other predetermined triggering event occurs.

The hatch railcar 14 of FIGS. 1-6 is exemplary and not intended to be limiting as to the meaning of "hatch railcars" as used in the present disclosure. Those skilled in the art will understand that hatch railcars and their components may have many variations that will still allow remote operation of railcar hatches as illustrated and described herein to be implemented. For example, "hatch doors" can be any type of door or other covering device that is movable to alternately cover and uncover an opening of a railcar. Hatch doors can include double doors such as the top hatch doors 58 and single doors such as the bottom hatch doors 78 of the hatch railcar 14 that rotate between open and closed positions, and similar hatch doors that may slide linearly to open and close the corresponding hatch openings, or move through other paths of motion. Moreover, hatch doors can includes multi-slat shutters and multi-panel doors that roll and unroll or fold and unfold to alternately uncover and cover an opening of a railcar. Additional covering devices are contemplated.

Similarly, "railcar hatch actuators" can include any type of actuator for opening and closing a particular hatch door that is implemented in a hatch railcar. The hatch actuators 50, 70 discussed above could be pneumatic, electro-mechanical, solenoid or other type of drive mechanisms that can respond to control signals to move the corresponding hatch doors 58, 78 between their closed and open positions. The Creighton et al. patent referenced above provides examples of railcar hatch actuators with which the systems and methods of the present disclosure could be implemented, but those skilled in the art will understand that many other types of actuator devices and coupling devices that are capable of converting movement or forces generated by the actuators into movement of the hatch doors may be implemented and are contemplated by the inventors.

In addition to the individual components, hatch railcars are not limited to the covered hopper railcars 14, 16, 20, 22 illustrated herein. Other types of railcars having doors or other covering devices that are opened and closed by actuators are contemplated for implementation of remote operation in accordance with the present disclosure. In addition, the hatch railcars need not have both top hatches and bottom hatches as shown in the exemplary embodiment, and may have top hatches or bottom hatches only. The hatch railcars may have multiple top hatches and/or multiple bottom hatches. Other hatch railcars may have openings with hatch doors on side walls or end walls of the railcar and accompanying actuators to open and close the doors that may be responsive to control signals from the operator station 26 or a remote location. Those skilled in the art will understand further alternative arrangements for hatch railcars in which the systems and methods of the present disclosure may be implemented, and such arrangements are contemplated by the inventors.

Figure 7:
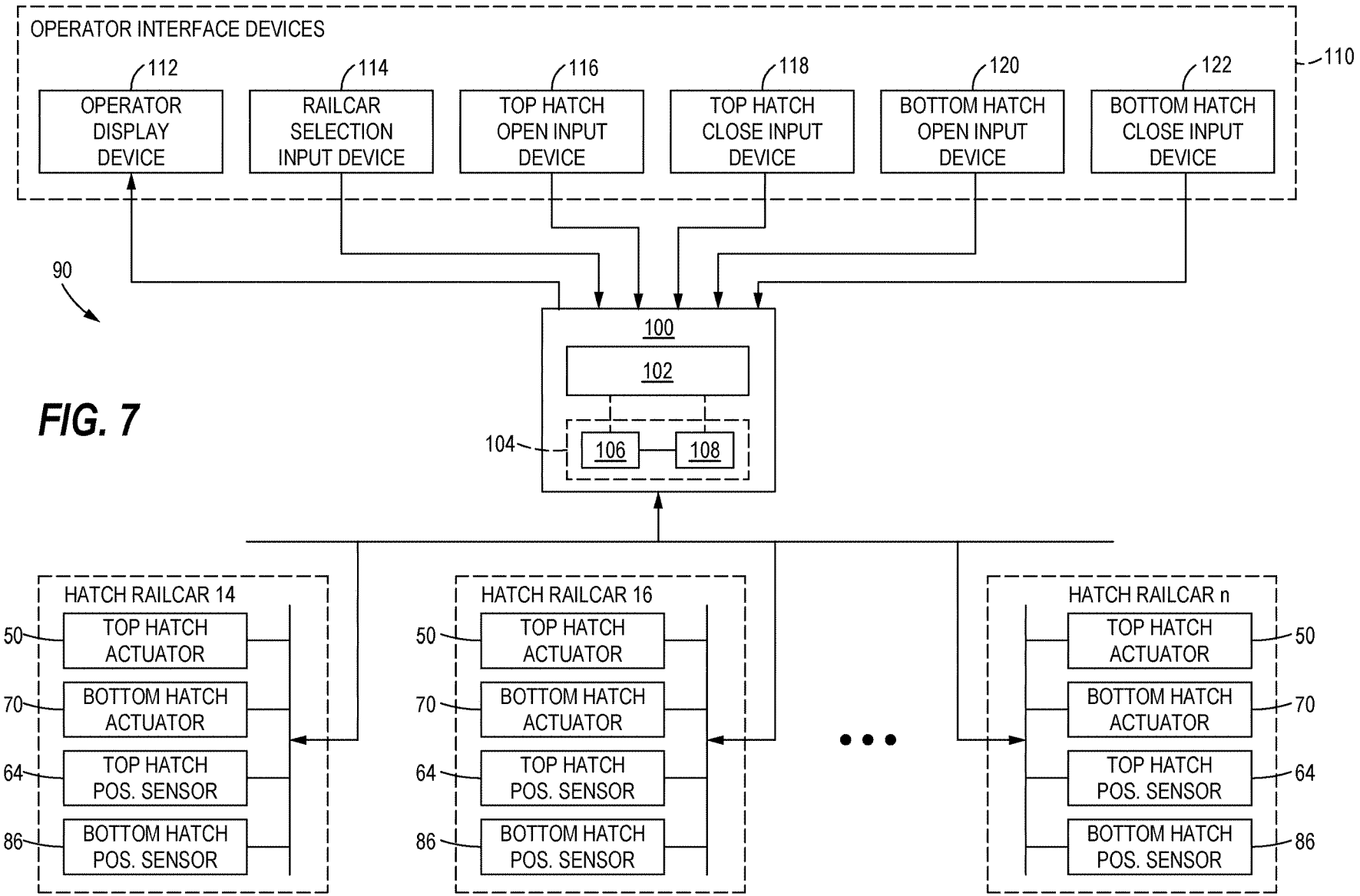
FIG. 7 is a block diagram of control components that may implement remotely operated railcar hatches in the multi-railcar train of FIG. 1 in accordance with the present disclosure.

Referring to FIG. 7, an exemplary arrangement of electrical and control components for the railcar hatch control system 90 and method for remotely operating railcar hatches of the present disclosure in the multi-railcar train 10 and other trains is shown. A controller 100 may be capable of processing information received from input devices and sensors using software stored at the controller 100, and outputting command and control signals to actuators and control elements of the multi-railcar train 10. The controller 100 may include a processor 102 for executing a specified program, which controls and monitors various functions associated with the multi-railcar train 10. The processor 102 may be operatively connected to a memory 104 that may have a read only memory (ROM) 106 for storing programs, and a random access memory (RAM) 108 serving as a working memory area for use in executing a program stored in the ROM 106. The memory 104 as illustrated is integrated into the controller 100, but those skilled in the art will understand that the memory 104 may be separate from the controller 100 but in the same location as the controller 100 such as on the locomotive 12 or other operator location, and/or remote from the controller 100 and the operator location, while still being associated with and accessible by the controller 100 to store information in and retrieve information from the memory 104 as necessary during the operation of the multi-railcar train 10.

Although the processor 102 is shown, it is also possible and contemplated to use other electronic components such as a microcontroller, an application specific integrated circuit (ASIC) chip, or any other integrated circuit device. While the discussion provided herein relates to the functionality of remotely operating railcar hatches, the controller 100 may be configured to control other aspects of the operation of the multi-railcar train such as, for example, operation of the engine(s), speed control, braking, signaling, communications with a central control system for the railroad network and the like. Moreover, the controller 100 may refer collectively to multiple control and processing devices across which the functionality of remotely operating the railcar hatches and other systems of the multi-railcar train 10 may be distributed. For example, each of the railcars 14-22 may have one or more railcar controllers that communicate with the controller 100. Such variations in consolidating and distributing the processing of the controller 100 as described herein, and implementing any necessary communications networks such as by using wireless communication links for communications between remote control devices and the multi-railcar train 10, are contemplated as having use in braking reduction and transmission control in accordance with the present disclosure.

The operator station 26 or remote operator location for the multi-railcar train 10 is provided with operator interface devices 110 that will allow an operator to remotely operate the railcar hatches 42, 44 of the hatch railcars 14, 16, 20, 22 in accordance with the present disclosure. For purposes of the present discussion, the hatch railcars 16, 20, 22 and additional hatch railcars (not shown) of the multi-railcar train 10 are substantially similar to the hatch railcar 14 as illustrated and described and including top hatch 42 and bottom hatch 44. However, as discussed above, the railcar hatch control system 90 and method of the present disclosure may be implemented with other types of hatch railcars. The operator interface devices 110 may include an operator display device 112 for displaying railcar identification information for each of the railcars 14-22 and additional railcars of the multi-railcar train 10. The operator display device 112 may be any appropriate electronic visual display device capable of displaying textual, numerical and/or graphical information representative of the railcars of the multi-railcar train 10. In some embodiments, the operator display device 112 is a display-only device that receives video signals from the controller 100 with data for producing the railcar identification information. The display-only device displays the information on the display, which could be a cathode ray tube (CRT), a light-emitting diode (LED) display, a plasma display panel (PDP), a liquid crystal display (LCD), an organic light-emitting diode (OLED), or any like display. In alternative embodiments, the operator display device 112 may be an input/output device such as a touchscreen that allows the operator to give input or control some of the operations of the multi-railcar train 10, including remote operation of railcar hatches 42, 44 as disclosed herein, while simultaneously displaying the railcar identification information. With an input/output display, the display will generate and transmit user input signals to the controller 100 as an operator touches the display while the controller 100 is transmitting the video signals to the operator display device 112.

The operator interface devices 110 may also include a railcar selection input device 114 that allows an operator to input information indicating a selection of one or more of the railcars 14-22 of the multi-railcar train 10. A specific configuration of the railcar selection input device 114 may be complementary to the operator display device 112 implemented in the operator station 26 or remote control location. For example, where the operator display device 112 is a video display, the railcar selection input device 114 may be a keypad or keyboard located proximate the operator display device 112. The operator may enter railcar identification information such as a railcar identification number, railcar name, or alphanumeric railcar identifier at the keypad or keyboard, and the railcar selection input device 114 may transmit corresponding railcar selection input signals to the controller 100. In another embodiment, the railcar selection input device 114 may include a mouse, trackball or joystick that can position the cursor on the video display of the operator display device 112 over displayed railcar identification information, and a selection button that may be actuated to cause the railcar selection input signals to be transmitted to the controller 100. In a further alternative embodiment, the operator display device 112 and railcar selection input device 114 may be integrated in a touchscreen where an operator can touch the operator display device 112 at a location of railcar identification information to select the corresponding railcar. When the operator's touch is detected, the touchscreen transmits railcar selection input signals to the controller 100 with the railcar identification information for the selected railcar. With any implementation of the railcar selection input device 114, the controller 100 may be programmed to receive the railcar selection input signals and store information indicating the selection of the railcar or railcars in the memory 104.

The operator interface devices 110 may also include hatch operation input devices 116-122 that will allow the operator to input railcar hatch operations it will be performed on the selected hatch railcar(s) 14, 16, 20, 22. As illustrated, there are separate hatch operation input devices for each operation that can be performed on the top hatch 42 and the bottom hatch 44 of the hatch railcars 14, 16, 20, 22. A top hatch open input device 116 generates railcar hatch operation input signals to cause the top hatch 42 to open, a top hatch close input device 118 generates railcar hatch operation input signals to cause the top hatch 42 to close, a bottom hatch open input device 120 generates railcar hatch operation input signals to cause the bottom hatch 44 to open, and a bottom hatch close input device 122 generates railcar hatch operation signals to cause the bottom hatch 44 to close. As with the railcar selection input device 114, specific configurations of the hatch operation input devices 116-122 may be complementary to the operator display device 112. Where the operator display device 112 is a video display, the hatch operation input devices 116-122 may be implemented as pushbuttons mounted on a panel proximate the operator display device 112 that may be depressed by the operator to input the desired railcar hatch operation.

Alternatively, the hatch operation input devices 116-122 may be implemented as switches on the control panel proximate the operator display device 112. The top hatch open input device 116 and top hatch close input device 118 may be combined in a first switch, and the bottom hatch open input device 120 and the bottom hatch close input device 122 may be combined in a second switch. The switches may be two position switches having a first position for the hatch open operation and a second position for the hatch closed operation, and transmitting railcar hatch operation input signals corresponding to the railcar hatch and the operation requested when either of the switches is moved between positions. Three position switches may have additional center or normal positions where the switches do not transmit railcar hatch operation input signals, but then transmit railcar hatch operation input signals when the switches are displaced from the center position to the hatch open position or the hatch close position. Where the operator display device 112 is a touchscreen, the screen may display graphics corresponding to each of the hatch operation input devices 116-122, with the touchscreen transmitting appropriate railcar hatch operation input signals when the operator touches the area of the graphics for one of the hatch operation input devices 116-122. Further alternative implementations of the hatch operation input devices 116-122 are contemplated by the inventors. When the controller 100 receives the railcar hatch operation input signals from the hatch operation input devices 116-122, the controller 100 responds by sending railcar hatch actuator control signals to the corresponding hatch actuators 50, 70 to open or close the corresponding hatch(s) 42, 44 as indicated by the railcar hatch operation input signals.

The controller 100 is also operatively connected to control and monitoring devices of each of the railcars 14-22 of the multi-railcar train 10. Relevant to the present disclosure, the controller 100 is operatively connected to the first hatch railcar 14, the second hatch railcar 16 and up through an $n^{th}$ hatch railcar. The illustrated railcars 14, 16, n each have a top hatch 42 and a bottom hatch 44, and consequently have a top hatch actuator 50, a top hatch position sensor 64, a bottom hatch actuator 70 and a bottom hatch position sensor 86 as described above. Other hatch railcars may have additional or fewer hatch actuators and hatch position sensors depending on the number of hatches on the particular rail car.

Figure 8:
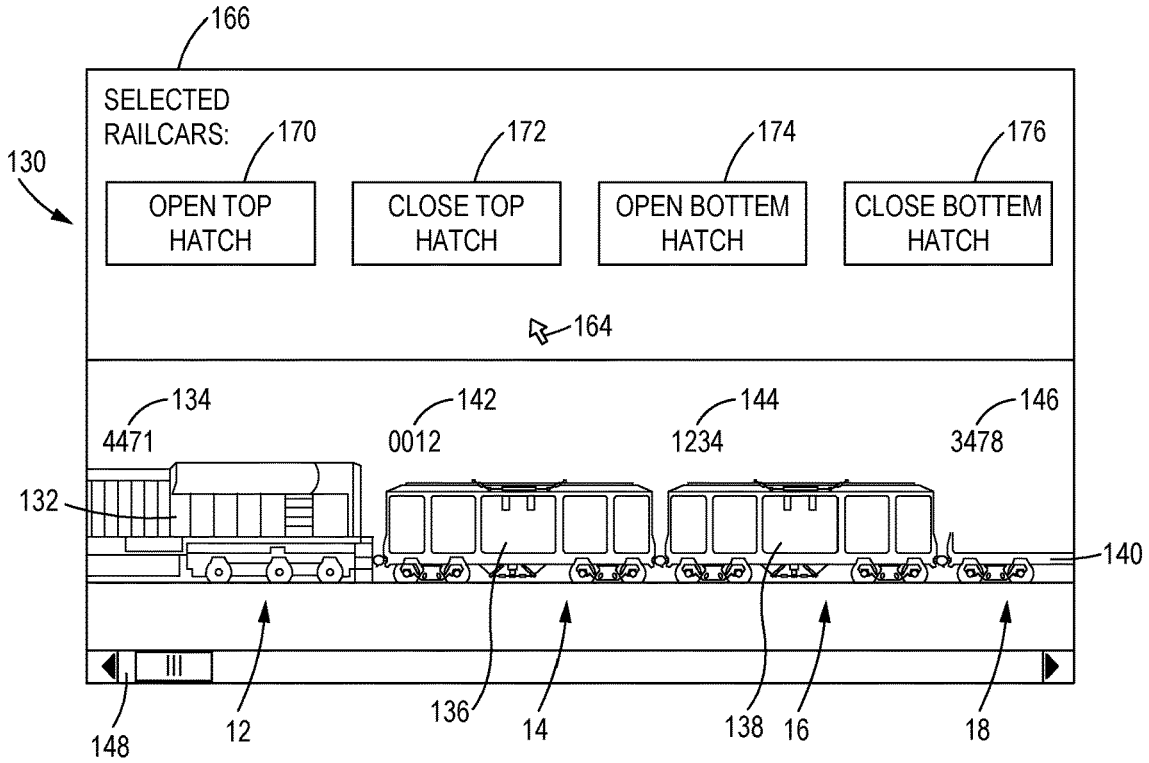
FIG. 8 is a front view of an exemplary touchscreen display for operator control of a railcar hatch control system in accordance with the present disclosure.

Referring to FIG. 8, an exemplary operator interface device 110 is shown in the form of a touchscreen 130 that may be mounted on a console in the operator station 26, at a remote operator location or on a handheld device. The touchscreen 130 may integrate the functionality for all of the operator interface devices 112-122 for the performance of remote operation of the railcar hatches 42, 44 in accordance with the present disclosure. The touchscreen 130 is operatively connected to the controller 100 to receive video display signals for the various graphical elements to be displayed on the touchscreen 130 and to transmit input signals in response to contact of the touchscreen 130 by an operator.

The video display signals may cause the touchscreen 130 display locomotive identification information for the locomotive 12 and railcar identification information for each of the railcars 14-22. The locomotive identification information for the locomotive 12 may include a locomotive graphic 132 and a locomotive identification number 134. Similarly, the railcar identification information may include railcar graphics 136, 138, 140 and railcar identification numbers 142, 144, 146 for the displayed railcars 14, 16, 18, respectively. The railcar graphics 136, 138, 140 may match the type of railcar being depicted. Consequently, the railcar graphics 136, 138 may represent railcars having top and bottom hatches 42, 44, while the railcar graphic 140 may represent a flatcar.

Figure 9:
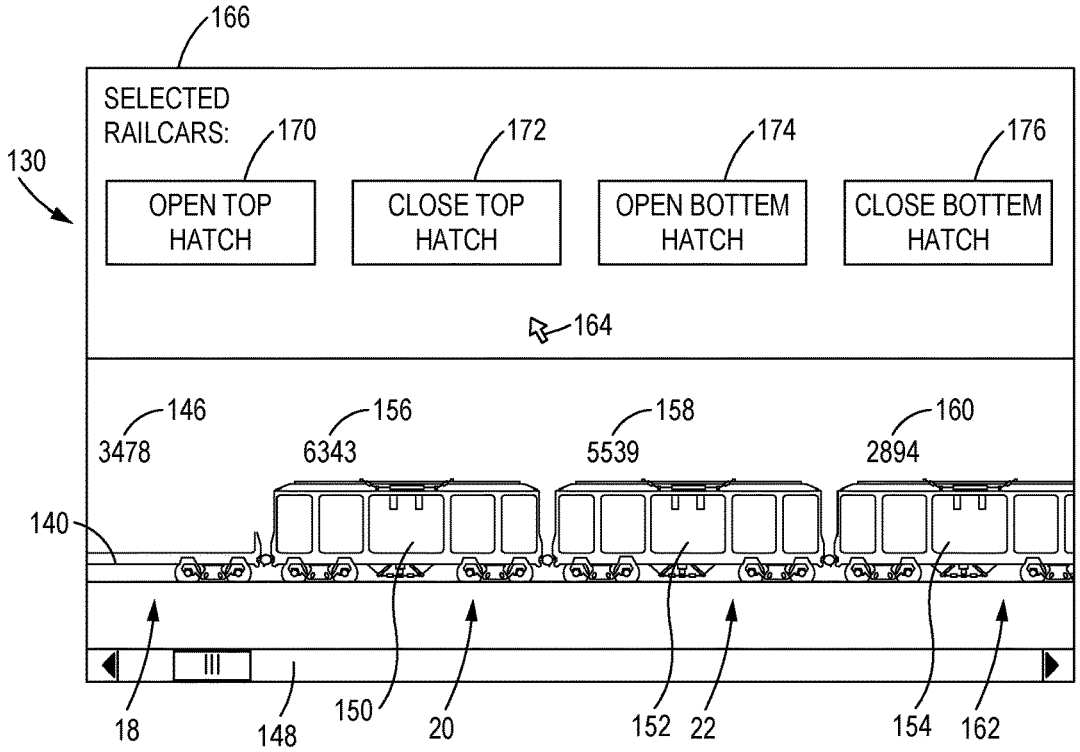
FIG. 9 is the front view of the touchscreen display of FIG. 8 with graphics for a multi-railcar train scrolled to the right.

To provide an accurate representation of the multi-railcar train 10 for the operator, the locomotive identification information and railcar identification information may be arranged in the same sequence as the locomotive 12 and the railcars 14-22. Because the multi-railcar train 10 may have too many railcars 14-22 to be meaningfully displayed all at once, a portion of the multi-railcar train 10 is displayed and a horizontal scrollbar 148 is provided to allow the operator to shift the train graphics to the left and right to see graphical images of the railcars 14-22 in a manner commonly known in the art. As shown in FIG. 9, the operator has scrolled to the right to a position where a portion of the railcar graphic 140 and the railcar identification number 146 are displayed along with railcar graphics 150, 152, 154 and railcar identification numbers 156, 158, 160 for the hatch railcars 20, 22 and an additional hatch railcar 162. Alternatively or in addition, the touchscreen 130 may allow the operator to swipe the screen to the left or right with their finger or a stylus to change the displayed portion of the multi-railcar train 10.

Figure 10:
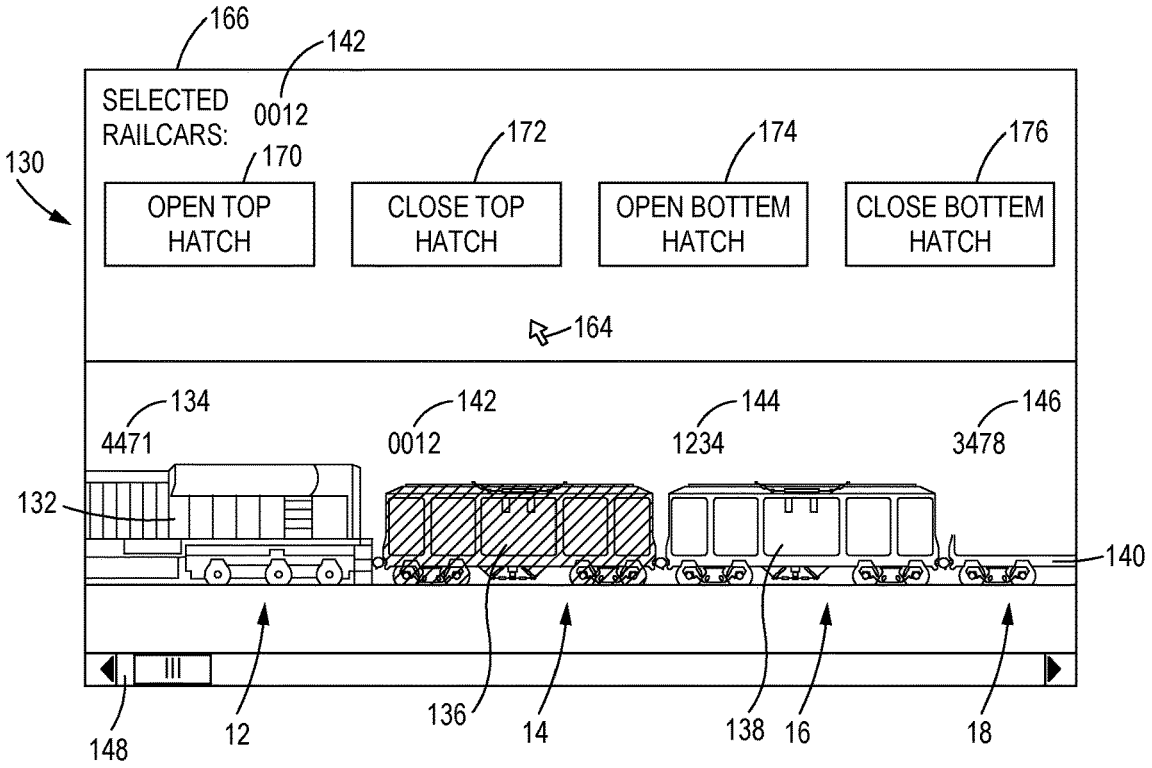
FIG. 10 is the front view of the touchscreen display of FIG. 8 with a railcar graphic highlighted to indicate an operator selection of the railcar.
Figure 11:
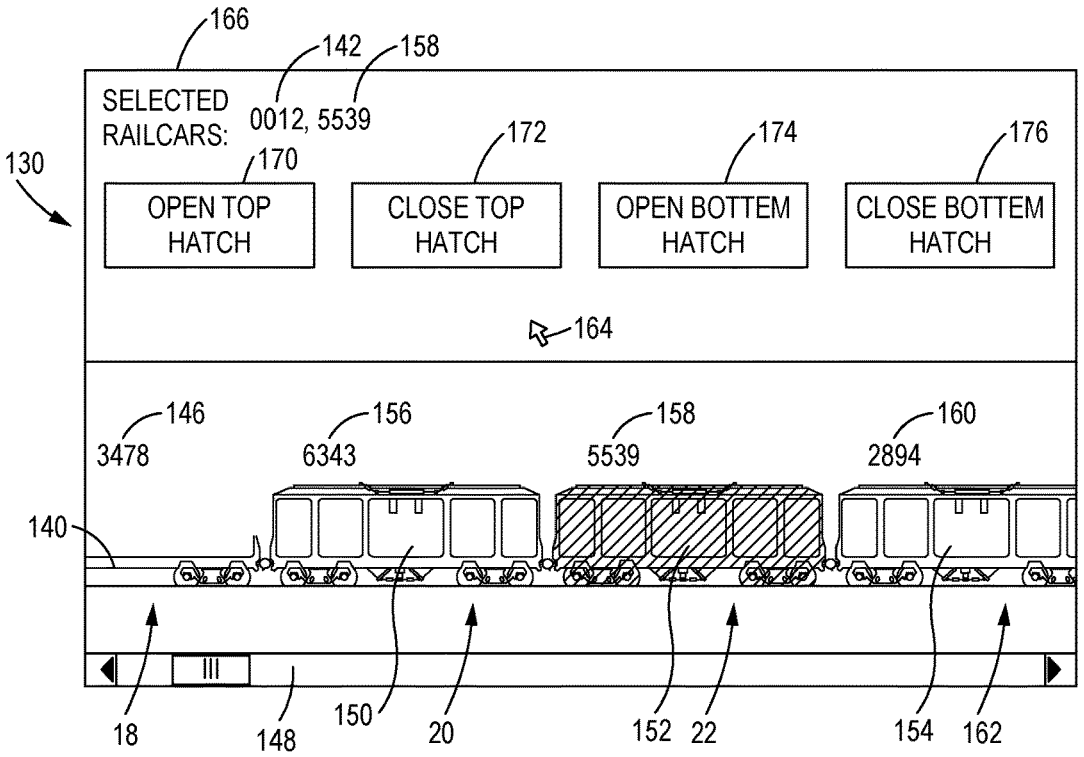
FIG. 11 is a front view of the touchscreen display of FIG. 9 with a railcar graphic highlighted to indicate an operator selection of the railcar.

The touchscreen 130 also functions as the railcar selection input device 114. When a hatch railcar 14, 16, 20, 22, 162 on which a hatch operation will be performed is displayed, the operator can touch the touchscreen 130 at the corresponding railcar graphic 136, 138, 150, 152, 154 or railcar identification number 142, 144, 156, 158, 160 to select the hatch railcar 14, 16, 20, 22, 162. For example, the operator may touch the touchscreen 130 at the railcar graphic 136 (FIG. 8) to select the railcar 14. Alternatively, the operator may use a mouse, trackball or joystick to move a cursor 164 over the railcar graphic 136 and actuate a button to select the railcar 14. Upon detecting the touch of the touchscreen 130 or the actuation of the button, the touchscreen 130 will transmit a railcar selection input signal to the controller 100 with information corresponding to the selection of the railcar 14. The controller 100 may store the information from the railcar selection input signal at the memory 104. At the same time, the controller 100 may transmit video signals to the touchscreen 130 to fresh the display and graphically indicate the selection of the railcar 14. For example, as shown in FIG. 10, the railcar graphic 136 for the railcar 14 may be highlighted or shaded after selection. In addition, the railcar identification number 142 for the railcar 14 may be added to a selected railcar area 166 of the touchscreen 130. The selected railcar area 166 may remain stationary on the touchscreen 130 to remind the operator of the selected hatch railcars 14-22, 162 as the operator repositions the railcar graphics 136-140, 150-154 on the touchscreen 130 and the selected railcar graphic(s) is/are not displayed. As shown in FIG. 11, the railcar graphic 136 is not currently displayed, but the railcar identification number 142 is displayed in the selected railcar area 166. Moreover, the hatch railcar 22 has been selected by the operator, so the railcar graphic 152 is highlighted and the railcar identification number 158 is added to the selected railcar area 166. If the operator wishes to unselect one of the selected hatch railcars 14, 22, they may touch the highlighted railcar graphic 136, 152, such as the railcar graphic 136. The touchscreen 130 will detect the contact and transmit railcar selection input signals to the controller 100 with information corresponding to the selection of the previously-selected hatch railcar 14. The controller 100 may update the memory 104 to cancel the selection of the hatch railcar 14, and transmit video signals to the touchscreen 130 to remove the shading from the railcar graphic 136 and remove the railcar identification number 142 from the selected railcar area 166.

The hatch operation input devices 116-122 may also be implemented at the touchscreen 130 of the illustrated embodiment. As shown in FIGS. 8-11, the display signals from the controller 100 cause the touchscreen 130 to display railcar hatch operation graphics such as a top hatch open button 170, a top hatch close button 172, a bottom hatch open button 174 and a bottom hatch close button 176, with the buttons 170-176 corresponding to the hatch operation input devices 116-122. When the operator touches the touchscreen 130 at one of the buttons 170-176, the touchscreen 130 will transmit corresponding railcar hatch operation input signals to the controller 100. The controller 100 will respond by causing the hatch operation specified in the railcar hatch operation input signals to be executed on the railcars 14-22, 162 that were previously selected by the operator. For example, if the operator touches the top hatch open button 170 after the railcar graphics 136, 152 have been selected for the hatch railcars 14, 22, respectively, as shown in FIG. 11, the touchscreen 130 will transmit railcar hatch operation input signals to the controller 100 corresponding to the top hatch open operation. The controller 100 may respond to the input signals by causing the top hatches 42 of the hatch railcars 14, 22 stored in the memory 104 to open. The controller 100 may transmit railcar hatch operation control signals to the top hatch actuators 50 of the hatch railcars 14, 22 to cause the top hatch actuators 50 to operate to open the top hatch doors 58. The hatch railcars 16-20, 162 that were not selected do not execute the top hatch open operation. As the top hatch doors 58 open, the corresponding top hatch position sensors 64 transmit hatch position sensor signals to the controller 100 indicating that the top hatch doors 58 have moved away from their closed positions.

Figure 12:
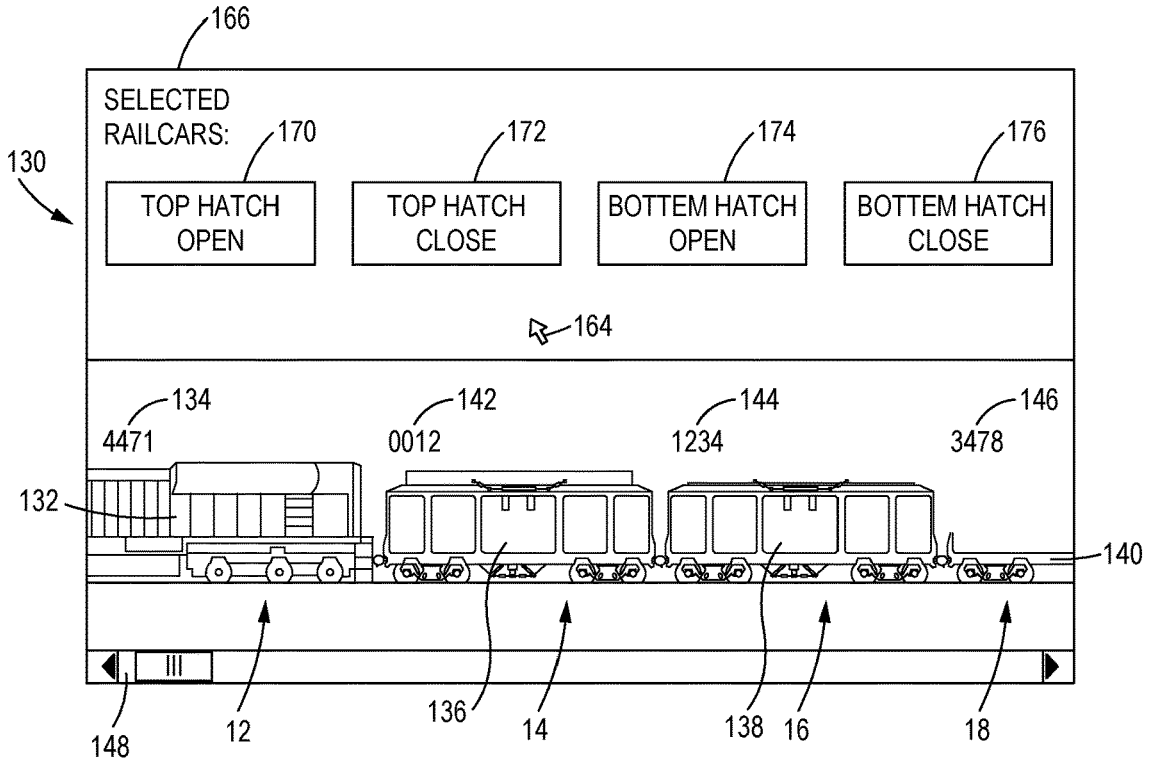
FIG. 12 is the front view of the touchscreen display of FIG. 8 with the railcar graphic modified to indicate an open top hatch of the railcar.
Figure 13:
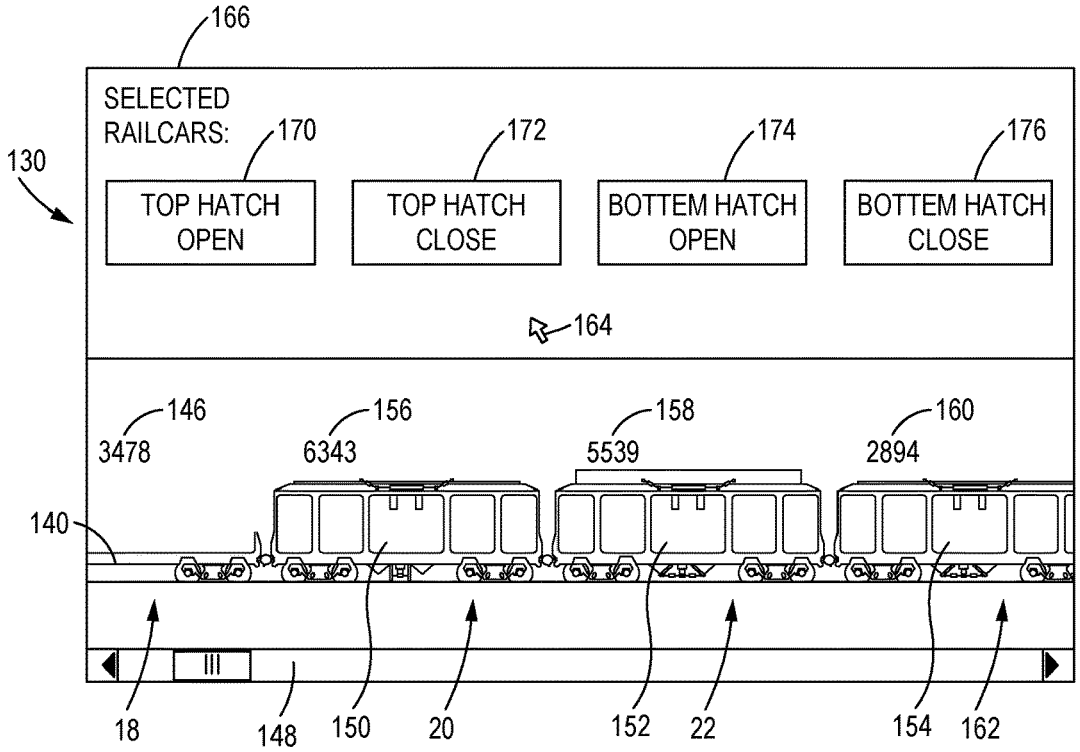
FIG. 13 is the front view of the touchscreen of FIG. 9 with the railcar graphic modified to indicate an open bottom hatch of the railcar.

In some embodiments, the display at the touchscreen 130 may remain unchanged after the selected hatch operation is executed. In other embodiments, the controller 100 may reset the railcar hatch control system 90 after executing the railcar hatch operation. For example, the controller 100 may clear the selection of data for the hatch railcars 14, 22 in the memory 104, and update a stored top hatch position status to "open." The controller 100 may also transmit display signals to the touchscreen 130 to update the display to clear the selections of the hatch railcars 14, 22. The display signals may cause the touchscreen 132 removed the shading from the railcar graphics 136, 152 and clear the railcar identification numbers 142, 158 from the selected railcar area 166 as shown in FIGS. 12 and 13. In addition, the status of the top hatches 42 of the hatch railcars 14, 22 as being open may be illustrated graphically by modifying the railcar graphics 136, 152 to display the top hatches in an open configuration as shown. When the bottom hatches 44 are open as indicated by the bottom hatch position sensors 86, the railcar graphics may be similarly modified to illustrate the bottom hatch in the open position, such as that shown in FIG. 13 for the railcar 20, the may have had the bottom hatch 44 open after a subsequent selection of the railcar graphic 150 and the bottom hatch open button 174 by the operator.

INDUSTRIAL APPLICABILITY

Figure 14:
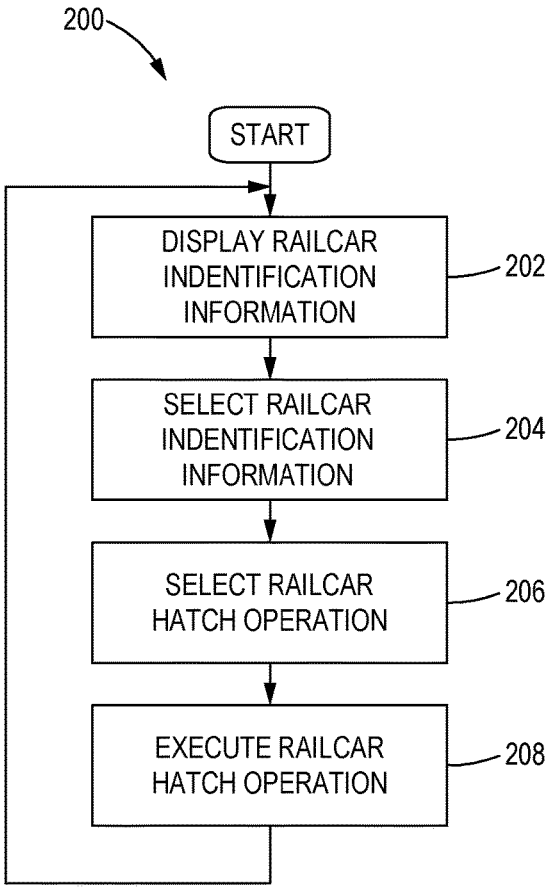
FIG. 14 is a flow diagram of a railcar hatch remote operation routine in accordance with the present disclosure.

The operation of the railcar hatch control system 90 may be discussed in relation to an exemplary railcar hatch remote operation routine 200 as shown in FIG. 14. The routine 200 will be described with reference to the railcar hatch control system 90 of FIG. 7 and the operator interface devices 110 implemented in the touchscreen 130 of FIGS. 8-13, but those skilled in the art will understand that the steps of the routine 200 may have equal application in alternative configurations of the railcar hatch control system 90 and implementations of the operator interface devices 110. The routine 200 may begin at a block 202 where railcar identification information for the railcars 14-22, 162 is displayed at the operator display device 112. In the illustrated embodiment, the controller 100 transmits display signals to the touchscreen 130 to create the displays shown in FIGS. 10 and 11, for example.

With the railcar identification information displayed at the operator display device 112, at a block 204, the operator may select railcar identification information for one of the plurality of railcars 14-22, 162 of the multi-railcar train 10 that is a hatch railcar 14, 16, 20, 22, 162. The railcar identification information selection may be executed using the railcar selection input device 114, such as by touching the railcar graphic 136, 138, 150, 152, 154 or the railcar identification number 142, 144, 156, 158, 160 of the hatch railcar 14, 16, 20, 22, 162 upon which a railcar hatch operation will be performed. Upon detecting the selection input, the touchscreen 130 may transmit the railcar selection input signals to the controller 100 with information identifying the one of the hatch railcars 14, 16, 20, 22, 162 that was selected by the operator. Additionally, the railcar identification information for the selected one of the hatch railcars 14, 16, 20, 22, 162 may be updated on the operator display device 112 to reflect the selection of the hatch railcar 14, 16, 20, 22, 162, such as by shading or highlighting the railcar graphic 136, 138, 150, 152, 154 and/or adding the railcar identification number 142, 144, 156, 158, 160 to the selected railcar area 166.

After the hatch railcar 14, 16, 20, 22, 162 is selected at the block 204, control may pass to a block 206 where the operator may select a railcar hatch operation to be performed on the selected one of the hatch railcars 14, 16, 20, 22, 162. The operator selection may be input at the hatch operation input devices 116-122, such as by touching the appropriate one of the hatch operation input buttons 170-176 on the touchscreen 130. Upon detecting the selection of one of the hatch operation input buttons 170-176, the touchscreen 130 may transmit railcar hatch operation input signals to the controller 100 with information identifying the hatch operation to be performed on the selected one of the hatch railcars 14, 16, 20, 22, 162.

When the railcar hatch operation input signals are transmitted, control may pass to a block 208 where the controller 100 will cause the specified hatch operation to be executed on the railcar hatch 42, 44 of the selected one of the hatch railcars 14, 16, 20, 22, 162. The controller 100 will transmit railcar hatch actuator control signals to the railcar hatch actuator 50, 70 of the one of the hatch railcars 14, 16, 20, 22, 162 to cause the railcar hatch actuator 50, 70 to execute the railcar hatch operation and either open or close the railcar hatch 42, 44 as specified in the operator's selection. It is to be noted that the specified railcar hatch operation is performed only on the selected one of the hatch railcars 14, 16, 20, 22, 162, and the operation is not performed on the hatch railcars 14, 16, 20, 22, 162 that have not been selected by the operator. At this time, the controller 100 may reset the railcar hatch control system 90 so that none of the hatch railcars 14, 16, 20, 22, 162 are indicated as being selected. After the railcar hatch operation is executed, control may pass back to the block 202 to refresh the display of the railcar identification information and await the operator selecting another hatch railcar 14, 16, 20, 22, 162 for performance of a railcar hatch operation.

Figure 15:
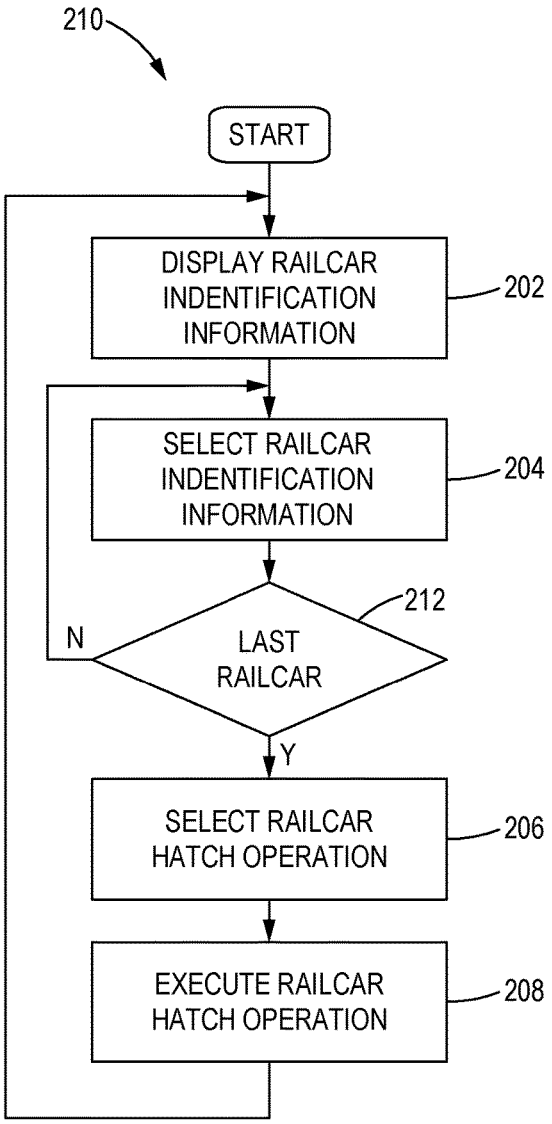
FIG. 15 is a flow diagram of an alternative embodiment of a railcar hatch remote operation routine in accordance with the present disclosure.

Variations of the railcar hatch remote operation routine 200 are contemplated based on the particular requirements for the railcar hatch control system 90 and ease of use for the operator. For example, FIG. 15 illustrates an alternative railcar hatch remote operation routine 210 that contemplates the selection of multiple of the hatch railcars 14, 16, 20, 22, 162 for execution of the selected railcar hatch operation on the multiple selected hatch railcars 14, 16, 20, 22, 162 with a single operator railcar hatch operation input. The routine 210 may include the blocks 202, 204, 206, 208 as described above. Control may pass to an additional block 212 after the selection of the railcar identification information at the block 204 to determine whether the selected hatch railcar 14, 16, 20, 22, 162 is the last hatch railcar upon which a railcar hatch operation will be performed. If there are additional hatch railcars 14, 16, 20, 22, 162 to be selected, control may pass back to the block 204 to await additional selections by the operator. If all the railcars 14, 16, 20, 22, 162 are selected, control passes to the block 206 for input of the railcar hatch operation by the operator at the hatch operation input devices 116-122.

The railcar hatch control system 90 in accordance with the present disclosure allows an operator to selectively open and close hatches on individual railcars or groups of railcars without performing the hatch operation on all hatch railcars of the multi-railcar train 10. The system also facilitates remote control of the railcar hatch operations. The hatches 42, 44 may be controlled via operator interface devices 110 in the operator station 26 on the locomotive 12, or the hatches 42, 44 may be remotely controlled from a back office operator station, a handheld device or other operator station that is remote from the multi-railcar train 10. In remote systems, after the operator selects a railcar hatch operation, such as opening or closing the hatches 42, 44 of one or more hatch railcars 14, 16, 20, 22, 162, the selection results in railcar hatch operation input signals being wirelessly communicated via a wireless communication link from the remote operator station to the controller 100 on the multi-railcar train 10, which then responds by transmitting railcar hatch actuator control signals to the selected hatch railcars 14, 16, 20, 22, 162 to perform the railcar hatch operation on only the selected hatch railcars 14, 16, 20, 22, 162.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A method for operating railcar hatches of a multi-railcar train having a locomotive and a plurality of railcars coupled in a line behind the locomotive, comprising:

displaying railcar identification information for each of the plurality of railcars on an operator display device;

selecting the railcar identification information for one of the plurality of railcars that is a hatch railcar having a railcar hatch;

selecting a railcar hatch operation to be performed on the railcar hatch of the one of the plurality of railcars, wherein the railcar hatch operation is one of opening the railcar hatch and closing the railcar hatch of the one of the plurality of railcars; and executing, by a hatch actuator, the railcar hatch operation on the railcar hatch of the one of the plurality of railcars in response to selecting the railcar hatch operation, wherein the railcar hatch operation is executed without executing the railcar hatch operation on the plurality of railcars that were not selected.

2. The method for operating railcar hatches of claim 1, wherein displaying the railcar identification information comprises displaying a railcar graphic of each of the plurality of railcars on the operator display device.

3. The method for operating railcar hatches of claim 1, comprising displaying selected railcar identification information in response to selecting the railcar identification information.

4. The method for operating railcar hatches of claim 1, wherein the railcar hatch of the one of the plurality of railcars comprises a top hatch that is movable by a top hatch actuator between a top hatch open position and a top hatch closed position, wherein the railcar hatch operation comprises a close top hatch operation when the top hatch is in the top hatch closed position and an open top hatch operation when the top hatch is in the top hatch open position, and wherein the hatch actuator comprises the top hatch actuator and executing the railcar hatch operation comprises:

causing the top hatch actuator to move the top hatch from the top hatch open position to the top hatch closed position in response to selecting the close top hatch operation; and causing the top hatch actuator to move the top hatch from the top hatch closed position to the top hatch open position in response to selecting the open top hatch operation.

5. The method for operating railcar hatches of claim 4, wherein the railcar hatch of the one of the plurality of railcars comprises a bottom hatch that is movable by a bottom hatch actuator between a bottom hatch open position and a bottom hatch closed position, wherein the railcar hatch operation comprises a close bottom hatch operation when the bottom hatch is in the bottom hatch closed position and an open bottom hatch operation when the bottom hatch is in the bottom hatch open position, and wherein the hatch actuator further comprises the bottom hatch actuator and executing the railcar hatch operation comprises:

causing the bottom hatch actuator to move the bottom hatch from the bottom hatch open position to the bottom hatch closed position in response to selecting the close bottom hatch operation; and causing the bottom hatch actuator to move the bottom hatch from the bottom hatch closed position to the bottom hatch open position in response to selecting the open bottom hatch operation.

6. The method for operating railcar hatches of claim 1, comprising:

selecting the railcar identification information for a second one of the plurality of railcars;

selecting the railcar hatch operation to be performed on the railcar hatch of the second one of the plurality of railcars, wherein the railcar hatch operation is one of opening the railcar hatch and closing the railcar hatch of the second one of the plurality of railcars; and executing the railcar hatch operation on the railcar hatch of the second one of the plurality of railcars in response to selecting the railcar hatch operation, wherein the railcar hatch operation is executed without executing the railcar hatch operation on the plurality of railcars that were not selected when the second one of the plurality of railcars was selected.

7. The method for operating railcar hatches of claim 1, wherein the railcar hatch of the one of the plurality of railcars is movable by a railcar hatch actuator between a railcar hatch open position and a railcar hatch closed position, wherein the railcar hatch operation comprises a close railcar hatch operation when the railcar hatch is in the railcar hatch closed position and an open railcar hatch operation when the railcar hatch is in the railcar hatch open position, wherein the method comprises displaying an open railcar hatch operation graphic and a close railcar hatch operation graphic, wherein selecting the railcar hatch operation comprises selecting one of the open railcar hatch operation graphic and the close railcar hatch operation graphic, and wherein the hatch actuator comprises the railcar hatch actuator and executing the railcar hatch operation comprises:

causing the railcar hatch actuator to move the railcar hatch from the railcar hatch open position to the railcar hatch closed position in response to selecting the close railcar hatch operation graphic; and causing the railcar hatch actuator to move the railcar hatch from the railcar hatch closed position to the railcar hatch open position in response to selecting the open railcar hatch operation graphic.

8. A railcar hatch control system for a multi-railcar train having a locomotive and a plurality of railcars coupled in a line behind the locomotive, wherein more than one of the plurality of railcars are hatch railcars each having a railcar hatch that is movable by a railcar hatch actuator between a railcar hatch open position and a railcar hatch closed position, the railcar hatch control system comprising:

an operator display device;

an operator input device;

a controller operatively connected to the operator display device, the operator input device and the railcar hatch actuator of each of the hatch railcars, the controller being programmed to:

cause the operator display device to display railcar identification information for each of the plurality of railcars, receive a railcar selection input signal from the operator input device representing selecting the railcar identification information for one of the hatch railcars, receive a railcar hatch operation input signal from the operator input device representing selecting a railcar hatch operation to be performed on the railcar hatch of the one of the hatch railcars, wherein the railcar hatch operation is one of opening the railcar hatch and closing the railcar hatch of the one of the hatch railcars, and transmit a railcar hatch actuator control signal to the railcar hatch actuator of the one of the hatch railcars to cause the railcar hatch actuator to execute the railcar hatch operation of the railcar hatch operation input signal on the railcar hatch of the one of the hatch railcars in response to receiving the railcar hatch operation input signal, wherein the railcar hatch operation is executed without executing the railcar hatch operation on railcar hatches of the hatch railcars that are not the one of the hatch railcars.

9. The railcar hatch control system of claim 8, wherein the operator display device, the operator input device and the controller are disposed at a location that is remote from the locomotive of the multi-railcar train, and wherein the controller is programmed to transmit the railcar hatch actuator control signal via a wireless communication link.

10. The railcar hatch control system of claim 8, wherein the railcar identification information displayed at the operator display device comprises a railcar graphic of each of the plurality of railcars.

11. The railcar hatch control system of claim 8, wherein the controller is programmed to cause the operator display device to change the railcar identification information for the one of the hatch railcars in response to receiving the railcar selection input signal.

12. The railcar hatch control system of claim 8, wherein the railcar hatch of the one of the hatch railcars comprises a top hatch and the railcar hatch actuator comprises a top hatch actuator that is operable to move the top hatch between a top hatch open position and a top hatch closed position, wherein the railcar hatch operation comprises a close top hatch operation when the top hatch is in the top hatch closed position and an open top hatch operation when the top hatch is in the top hatch open position, and wherein the controller is programmed to;

cause the top hatch actuator to move the top hatch from the top hatch open position to the top hatch closed position in response to determining that the railcar hatch operation input signal is a close top hatch operation input signal; and causing the top hatch actuator to move the top hatch from the top hatch closed position to the top hatch open position in response to determining that the railcar hatch operation input signal is an open top hatch operation input signal.

13. The railcar hatch control system of claim 12, wherein the railcar hatch of the one of the hatch railcars comprises a bottom hatch and the railcar hatch actuator comprises a bottom hatch actuator that is operable to move the bottom hatch between a bottom hatch open position and a bottom hatch closed position, wherein the railcar hatch operation comprises a close bottom hatch operation when the bottom hatch is in the bottom hatch closed position and an open bottom hatch operation when the bottom hatch is in the bottom hatch open position, and wherein the controller is programmed to:

cause the bottom hatch actuator to move the bottom hatch from the bottom hatch open position to the bottom hatch closed position in response to determining that the railcar hatch operation input signal is a close bottom hatch operation input signal; and causing the bottom hatch actuator to move the bottom hatch from the bottom hatch closed position to the bottom hatch open position in response to determining that the railcar hatch operation input signal is an open bottom hatch operation input signal.

14. The railcar hatch control system of claim 8, wherein the controller is programmed to:

receive a second railcar selection input signal from the operator input device representing selecting the railcar identification information for a second one of the hatch railcars, receive a second railcar hatch operation input signal from the operator input device representing selecting the railcar hatch operation to be performed on the railcar hatch of the second one of the hatch railcars, wherein the railcar hatch operation is one of opening the railcar hatch and closing the railcar hatch of the second one of the hatch railcars, and transmit a second railcar hatch actuator control signal to the railcar hatch actuator of the second one of the hatch railcars to cause the railcar hatch actuator to execute the railcar hatch operation of the railcar hatch operation input signal on the railcar hatch of the second one of the hatch railcars in response to receiving the second railcar hatch operation input signal, wherein the railcar hatch operation is executed without executing the railcar hatch operation on the railcar hatch of each of the hatch railcars that are not the second one of the hatch railcars.

15. A method for operating railcar hatches of a multi-railcar train having a locomotive and a plurality of railcars coupled in a line behind the locomotive, comprising:

displaying railcar identification information for each of the plurality of railcars on an operator display device;

selecting the railcar identification information for a first subset of the plurality of railcars that are hatch railcars each having a railcar hatch;

selecting a railcar hatch operation to be performed on the railcar hatch of each of the first subset of the plurality of railcars, wherein the railcar hatch operation is one of opening the railcar hatch and closing the railcar hatch of each of the first subset of the plurality of railcars; and executing, by a hatch actuator, the railcar hatch operation on the railcar hatch of each of the first subset of the plurality of railcars in response to selecting the railcar hatch operation, wherein the railcar hatch operation is executed without executing the railcar hatch operation on the railcar hatch of each of the hatch railcars that were not selected.

16. The method for operating railcar hatches of claim 15, wherein displaying the railcar identification information comprises displaying a railcar graphic of each of the plurality of railcars on the operator display device.

17. The method for operating railcar hatches of claim 15, wherein the railcar hatch of each of the first subset of the plurality of railcars comprises a top hatch that is movable by a top hatch actuator between a top hatch open position and a top hatch closed position, wherein the railcar hatch operation comprises a close top hatch operation when the top hatch is in the top hatch closed position and an open top hatch operation when the top hatch is in the top hatch open position, and wherein the hatch actuator comprises the top hatch actuator and executing the railcar hatch operation comprises:

causing the top hatch actuator for each of the first subset of the plurality of railcars to move the top hatch from the top hatch open position to the top hatch closed position in response to selecting the close top hatch operation; and causing the top hatch actuator for each of the first subset of the plurality of railcars to move the top hatch from the top hatch closed position to the top hatch open position in response to selecting the open top hatch operation.

18. The method for operating railcar hatches of claim 17, wherein the railcar hatch of each of the first subset of the plurality of railcars comprises a bottom hatch that is movable by a bottom hatch actuator between a bottom hatch open position and a bottom hatch closed position, wherein the railcar hatch operation comprises a close bottom hatch operation when the bottom hatch is in the bottom hatch closed position and an open bottom hatch operation when the bottom hatch is in the bottom hatch open position, and wherein the hatch actuator further comprises the bottom hatch actuator and executing the railcar hatch operation comprises:

causing the bottom hatch actuator for each of the first subset of the plurality of railcars to move the bottom hatch from the bottom hatch open position to the bottom hatch closed position in response to selecting the close bottom hatch operation; and causing the bottom hatch actuator for each of the first subset of the plurality of railcars to move the bottom hatch from the bottom hatch closed position to the bottom hatch open position in response to selecting the open bottom hatch operation.

19. The method for operating railcar hatches of claim 15, comprising:

selecting the railcar identification information for a second subset of the plurality of railcars that have railcar hatches;

selecting a second railcar hatch operation to be performed on the railcar hatch of each of the second subset of the plurality of railcars, wherein the second railcar hatch operation is one of opening the railcar hatch and closing the railcar hatch of each of the second subset of the plurality of railcars; and executing the second railcar hatch operation on the railcar hatch of each of the second subset of the plurality of railcars in response to selecting the second railcar hatch operation, wherein the second railcar hatch operation is executed without executing the railcar hatch operation on railcar hatches of the hatch railcars that were not selected in the second subset of the plurality of railcars.

20. The method for operating railcar hatches of claim 15, wherein the railcar hatch of each of the first subset of the plurality of railcars is movable by a railcar hatch actuator between a railcar hatch open position and a railcar hatch closed position, wherein the railcar hatch operation comprises a close railcar hatch operation when the railcar hatch is in the railcar hatch closed position and an open railcar hatch operation when the railcar hatch is in the railcar hatch open position, wherein the method comprises displaying an open railcar hatch operation graphic and a close railcar hatch operation graphic, wherein selecting the railcar hatch operation comprises selecting one of the open railcar hatch operation graphic and the close railcar hatch operation graphic, and wherein the hatch actuator comprises the railcar hatch actuator and executing the railcar hatch operation comprises:

causing the railcar hatch actuator for each of the first subset of the plurality of railcars to move the railcar hatch from the railcar hatch open position to the railcar hatch closed position in response to selecting the close railcar hatch operation graphic; and causing the railcar hatch actuator for each of the first subset of the plurality of railcars to move the railcar hatch from the railcar hatch closed position to the railcar hatch open position in response to selecting the open railcar hatch operation graphic.

* * * * *